US005492609A

United States Patent [19]

Assenmacher

[11] Patent Number: 5,492,609

[45] Date of Patent: Feb. 20, 1996

[54] CATHODE FOR ELECTROLYTIC REFINING OF COPPER

[75] Inventor: William Assenmacher, Tucson, Ariz.

[73] Assignee: T. A. Caid Industries, Inc., Tucson, Ariz.

[21] Appl. No.: 326,879

[22] Filed: Oct. 21, 1994

[51] Int. Cl.[6] ..... C25C 7/02

[52] U.S. Cl. ..... 204/286; 29/879; 204/288; 204/297 R

[58] Field of Search ..... 29/825, 879; 204/286, 204/288, 297 R, 280; 228/262.42, 262.43, 262.44, 262.6, 262.61, 170, 262.41

[56] References Cited

U.S. PATENT DOCUMENTS

| | | | |
|---|---|---|---|
| 4,186,674 | 1/1980 | Perry | 204/286 |
| 4,288,312 | 9/1981 | Johnson et al. | 204/286 |
| 4,647,358 | 3/1987 | Bartsch et al. | 204/288 |

FOREIGN PATENT DOCUMENTS

| | | | |
|---|---|---|---|
| 2104549 | 3/1983 | United Kingdom | 204/280 |

*Primary Examiner*—Kathryn Gorgos
*Attorney, Agent, or Firm*—Antonio R. Durando

[57] ABSTRACT

An improved method of manufacture for electrolytic cathode devices that include a copper hanger-bar with a rounded underside that ensures the automatic vertical positioning of the cathode's blank starter sheet with respect to horizontal supporting bus-bars irrespective of warpage or construction defects. The mechanical connection between the hanger bar and the starter sheet is achieved by inserting the latter's upper edge into a receiving groove in the underside of the hanger bar and by welding the entire length of connection, thereby establishing a large boundary surface for good electrical conductance. One embodiment of the invention also features notched lateral edges that increase the rigidity of the starter sheet and allow the ready installation and removal of conforming insulating strips.

13 Claims, 3 Drawing Sheets

CATHODE FOR ELECTROLYTIC REFINING OF COPPER

BACKGROUND OF THE INVENTION

1. Field of the Invention

This invention is related in general to electrolytic processes and equipment for refining copper. In particular, it describes a method of construction for an improved electrolytic cathode.

2. Description of the Related Art

The principle of electrolysis has been utilized for decades to extract metals and other cations from an electrolytic solution. The extraction process is carried out by passing an electric current through an electrolyte solution of the metal of interest, such as copper, gold, silver, or lead. The metal is extracted by electrical deposition as a result of current flow between a large number of anode and cathode plates immersed in cells of a dedicated extraction tank house. The anode is made of a material that is dissolved and, therefore, is lost during the process, while the cathode is generally constructed of a metal alloy, such as titanium or copper alloys and various grades of stainless steel (316L, 2205, etc.), resistant to corrosive acid solutions. In the most efficient processes, each cathode consists of a thin sheet of metal of uniform thickness (2–4 mm) disposed vertically between parallel sheets of anodic material, so that an even current density is present throughout the surface of the cathode. A solution of metal-rich electrolyte and various other chemicals, as required to maintain an optimal rate of deposition, are circulated through the extraction cells; thus, as an electrical current is passed through the anodes, electrolyte and cathodes, a pure layer of electrolyte metal is electro-deposited on the cathode surface, which becomes plated by the process.

Similarly, to purify a metal in a refinery process using electro-deposition, an anode of impure metal is placed in an electrolytic solution of the same metal and subjected to an electric current passing through the anode, electrolyte and cathode of each cell. The anode goes into solution and the impurities drop to the bottom of the tank. The dissolved metal then follows the current flow and is deposited in pure form on the cathode, which typically consists of a starter sheet of stainless steel. When a certain amount of pure metal has been plated onto the starter sheet, the cathode is pulled out of the tank and stripped of the pure metal.

In both processes, the pure metal deposit is grown to a specific thickness on the cathode during a predetermined length of time and then the cathode is removed from the cell. It is important that the layer of metal deposited be recovered in uniform shapes and thicknesses and that its grade be of the highest quality, so that it will adhere to the cathode blank during deposition and be easily removed by automated stripping equipment afterwards. The overall economy of the production process depends in part on the ability to mechanically strip the cathodes of the metal deposits at high throughputs and speeds without utilizing manual or physical intervention. To that end, the cathode blanks must have a surface finish that is resistant to the corrosive solution of the tank house and must be strong enough to withstand their continuous handling by automated machines without pitting or marking. Any degradation of the blank's finish causes the electro-deposited metal to bond with the cathode resulting in difficulty of removal and/or contamination of the deposited metal.

Also immensely important in the production and refining of metals by electrolytic extraction is the relationship of electrical power consumption with metal-production rates. The total weight of deposited metal can be calculated theoretically by knowing the actual energy used, the concentration of metal in solution, the average residence time, the number of cells, and the surface area available for deposition in each cell. In practice, all electrical voltages and flow rates are continuously monitored throughout the deposition cycle to optimize the electrolytic process. After the cathodes have been pulled out of the cells and the deposited metal has been stripped and weighed, the electrolytic-product weight is divided by the theoretical cell-production weight to determine the cell efficiently. A cell efficiency of ninety-five percent or better is the goal for the best operations.

In order to achieve this level of efficiency, the voltage profile across the cathodic deposition surface must be held constant and variations avoided. Shorts due to areas of high current density caused by nodulization or by curved cathode surfaces that touch the anode must be prevented. Therefore, the details of construction of cathode blanks are very important to minimize operational problems and ensure high yields.

U.S. Pat. No. 4,186,674 to Perry (1980) describes a cathode for the electrolytic refining of copper that has been considered as the state of the art in the industry. It consists of a stainless steel hanger bar point-welded to a stainless-steel starter sheet hanging from it in vertical position (see FIG. 1). The hanger bar has a flat bottom face for maximum surface contact and corresponding maximum electrical conductance with support bus-bars through which the system is energized. In order to reduce the electrical resistance resulting from the welds between the hanger bar and the starter sheet, the hanger bar and the upper edge of the starter sheet are uniformly clad with copper, thereby creating a low-resistance boundary between the two. In addition, in order to prevent deposit build-up along the lateral edges of the starter sheet that would impede the automated separation of the product at the end of each cycle, these edges are masked with an insulating strip riveted to the electrode.

While amounting to a substantial improvement over the prior art, the Perry cathode retains some features that have proven to cause problems from time to time. The flat bottom face of the hanger bar tends to remain positioned in full contact with the bus-bars even when the starter sheet is not perfectly perpendicular to it because of warpage or construction defects. The result is that the starter sheet does not hang perfectly vertical and its distance from the surrounding anodes is not uniform, sometimes being even in shorted contact thereto. This condition causes nonuniform deposits that affect the efficiency of operation and the quality of the product.

Another problem arises when, due to wear, pits and faults develop in the copper cladding around the hanger bar. Then the steel underneath (the material of which the bar is made) is exposed to the corrosive atmosphere of the electrolytic tank house, rapidly leading to a build-up of high-resistance corrosion spots that decrease the conductivity of the whole electrode. Such corrosion eventually causes enough structural damage to require replacement of the hanger bar and reconditioning of the cathode. In addition, after the copper plating is sufficiently worn out to become ineffective as a conductor at the boundary between the hanger bar and the starter sheet, the current flow is restricted to the points welded between them, which have a relatively high resistance and therefore affect the efficiency of the cathode as well.

Finally, the method shown by Perry for securing the insulating strips to the lateral edges of the cathode is rather cumbersome and requires chemical bonding to avoid bulging between pin fasteners. Therefore, it is not suitable for rapid replacement of damaged strips.

In view of the above, there still exists a need for an improved electrolytic cathode that overcomes these problems. The present invention provides a simple method of construction for producing electrodes that fulfill this need.

BRIEF SUMMARY OF THE INVENTION

The primary objective of this invention is a simplified method of construction for a cathode that has optimal electrical characteristics for the electrolytic production and refining of copper.

Another goal of the invention is a cathode having a geometry that guarantees the best verticality attainable while hanging from standard horizontal bus-bars.

Another objective is to provide a cathode that performs reliably when used with all types of automated mechanical stripping machines, cathode handling equipment, and various types of edge strips.

Another goal is a method of assembly that ensures optimal electrical conductance between the cathode's hanger bar and starter sheet while reducing production costs by eliminating the copper cladding between the two.

Still another goal of the invention is to provide an electrically-efficient cathode assembly that is capable of receiving a maximum amount of deposited metal while being easily stripped and reused during the life of its components.

Finally, an objective is a design and method of manufacture for such a cathode that accomplishes the above mentioned goals in an economical and commercially viable manner.

Therefore, according to these and other objectives, the present invention consists of an electrolytic cathode comprising a copper hanger-bar having a rounded underside that automatically produces the perfectly vertical positioning of the cathode's blank starter sheet with respect to horizontal supporting bus-bars irrespective of warpage or construction defects. The mechanical connection between the hanger bar and the starter sheet is achieved by inserting the latter's upper edge into a receiving groove in the underside of the hanger bar and by welding the entire length of connection, thereby establishing a large boundary surface for good electrical conductance. One embodiment of the invention also features notched lateral edges that increase the rigidity of the starter sheet and allow the ready installation and removal of conforming insulating strips.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced.

DESCRIPTION OF THE PREFERRED EMBODIMENTS OF THE INVENTION

Figure 1:
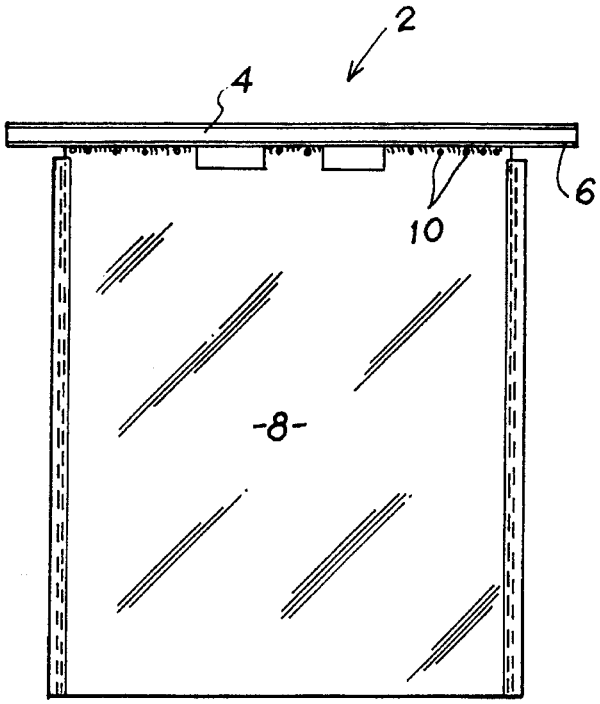
FIG. 1 (PRIOR ART)
FIG. 1 is an elevational view of a prior-art cathode for the electro-deposition of copper electrolytes.

The heart of this invention lies in the method of assembly of the disclosed electrolytic cathode and in novel structural features that improve its performance and durability. As illustrated in elevational view in FIG. 1, an electrolytic cathode 2 according to the prior art includes a stainless-steel hanger bar 4 with a flat underside 6 and a starter sheet 8 (normally stainless steel) that abuts and is attached to the underside 6 by means of a plurality of stitch welds 10 along the upper edge of the starter sheet. The whole attachment is encased in an electroplated copper coating. As mentioned above, these features often produce operational problems.

Figure 2:
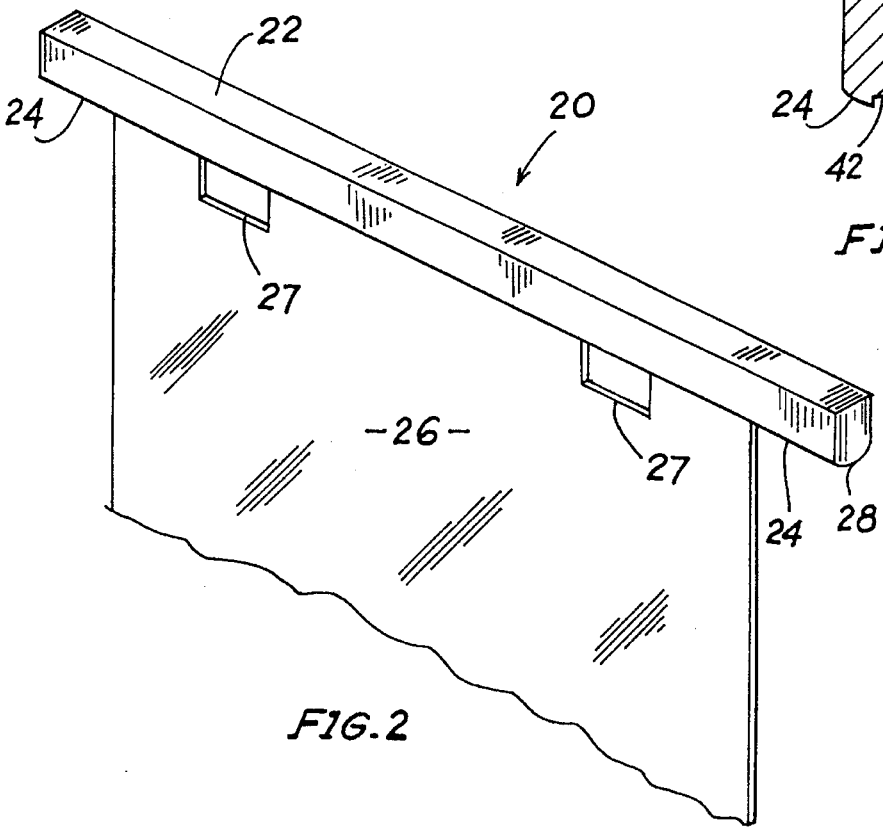
FIG. 2 is a partial perspective view of the preferred embodiment of a cathode for the electro-deposition of copper electrolytes manufactured according to the present invention.
Figure 3:
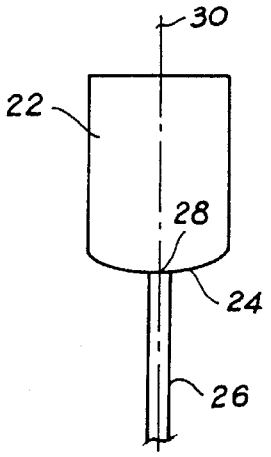
FIG. 3 is a partial side view of the cathode shown in FIG. 2.
Figure 4:
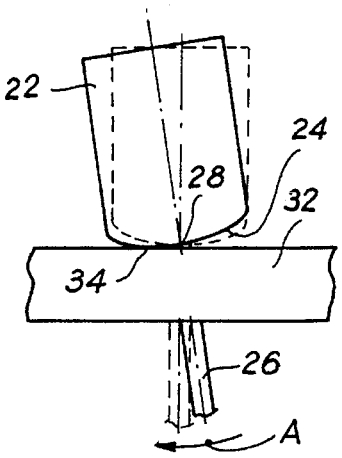
FIG. 4 is a partial side view of the cathode of FIG. 2 shown rotating toward a vertical position on a supporting bus-bar.

Referring to the drawings of the present invention, wherein like parts are designated throughout with like numerals and symbols, FIG. 2 shows in partial perspective view a cathode 20 according to the present invention. It comprises a header bar or hanger bar 22 with a uniformly rounded underside 24 (that is, having a convex cross-section). A flat starter sheet 26 is attached to the hanger bar substantially along the lowest region 28 of the underside, in alignment with the cross-sectional vertical axis 30 of the hanger bar, as clearly illustrated in the partial side view of FIG. 3. The curvature of the underside 24 allows its rotation toward a vertical position (arrow A), illustrated in phantom line in FIG. 4, over conventional horizontal supporting bus-bars 32. Thus, the starter sheet 26 can automatically dispose itself by gravity in a substantially vertical position with its center of gravity aligned with the line of contact 34 of the hanger bar with the supporting bus-bar 32. As all standard cathodes used in the industry, the starter sheet 26 (also called mother plate or mother blank in the industry) contains windows 27 at the top end to provide openings for mechanical handling of the cathode by automated equipment.

By ensuring the vertical positioning of each cathode between parallel anodes in the electrolytic cells, this feature optimizes the uniformity of separation between electrodes and, given any structural imperfections in the starter sheets, provides optimal distribution of current flow and metal deposition. This is a great advantage during the typically-long lifetime of a cathode (in the order of decades) because it reduces the incidence of electrical shorts that warping and other damage to the starter sheet may cause. It is noted that the typical thickness of a starter sheet is from about 2.9 to 3.2 mm, and that the face-to-face distance between cathode and anode is in the order of millimeters (such as 25 mm). Therefore, any imperfection in the flatness or verticality of the starter sheet could readily result in costly electrical shorts.

In conventional electrolytic equipment, the hanger bar is approximately 130 cm long, 2.5 cm wide and 3.8 cm high; and the typical starter sheet is 110 cm high, 100 cm wide and 3 mm thick. I found that a radius of curvature of about 5 cm ensures freedom of rotation of the cathode to freely achieve a vertical position.

The second improvement of the present invention consists of the connection between the hanger bar 22 and the starter sheet 26. Instead of relying on low-conductance stitch welds between the two and then cladding them with a highly conductive layer of copper to improve performance, the apparatus of the invention comprises a copper hanger bar with a continuous weld connection along the entire top edge of the hanger bar. Thus, electrical conductivity at the boundary is greatly increased and copper cladding becomes unnecessary.

Figure 7:
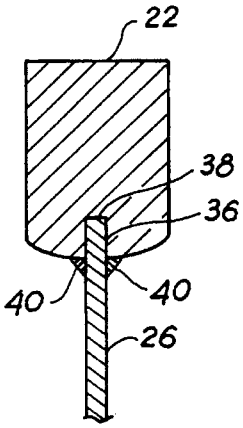
FIG. 7 is a cross-sectional side view of the cathode of FIG. 5 as seen from line 7—7 in that figure.
Figure 5:
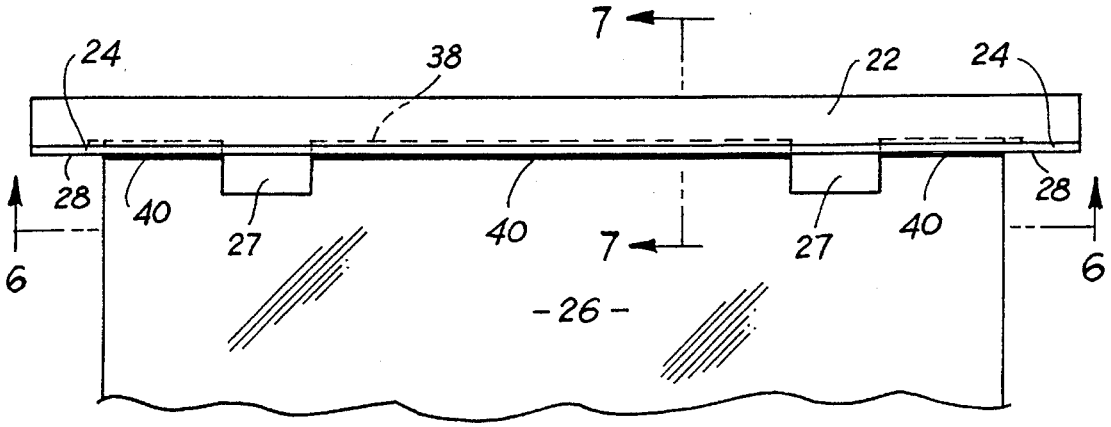
FIG. 5 is a partial elevational view of cathode of the invention illustrating the method of assembly of the copper hanger bar with the stainless-steel starter sheet.
Figure 6:
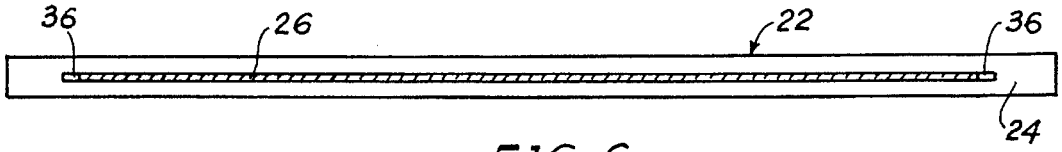
FIG. 6 is a cross-sectional bottom view of the cathode of FIG. 5 as seen from line 6—6 in that figure.

As shown in FIGS. 5 and 6, a longitudinal inset groove 36 is milled along the center of the underside 24 of the hanger bar 22 for receiving the top edge 38 of the starter sheet 26. The groove 36 is cut with the proper clearance to allow the metal-alloy blade (normally a stainless steel) constituting the starter sheet 26 to fit tightly without being forced and of sufficient length to accommodate the full length of the top edge 38. The two units are then welded together, typically by arc-welding in a tungsten inert gas (T.I.G.) process with a copper rod 40 (better seen in FIG. 7), along the entire length of the insert on both sides of the edge 38. A groove about 6.4 mm deep is optimal for providing sufficient contact for welding of the parts. Thus, the copper hanger bar and the starter sheet are bonded into one electrically compatible unit with the strength of a continuously welded structure. The assembled components are illustrated in the cross-sectional view of FIG. 7.

The welding step of this invention is preferably performed by a tungsten inert gas process with a pure copper rod. In order to ensure a uniform weld along the length of the starter sheet 26, it is critical that the heat generated by the welding process be distributed uniformly along the hanger bar 22 and that hot spots be avoided. Accordingly, it is advisable to couple the top portion of the hanger bar to an efficient and evenly-distributed heat sink during welding. For example, the hanger bar 22 may be partly immersed in a liquid bath of thermally-conductive material, where the liquid is possibly circulating at a rate controlled to maintain the hanger bar's temperature as constant and uniform as practically possible. Such a set-up minimizes the presence of temperature differentials that may lead to substandard welds and ultimately to separation, corrosion and failure of the electrode.

This method of construction eliminates the need for cladding the hanger-bar/starter-sheet assembly with a high conductivity metal to improve cathode performance. Therefore, it eliminates one step from the manufacturing process and avoids the corrosion and reduced-efficiency problems associated with wear of the cladding during the life of the cathode. Moreover, this method of construction can obviously be utilized in various dimensions to provide versatility of use with any automated mechanical operation for stripping deposited metal; also, this cathode is adaptable to any electro-deposition process that may be incorporated in various types of plating methods.

Figure 9:
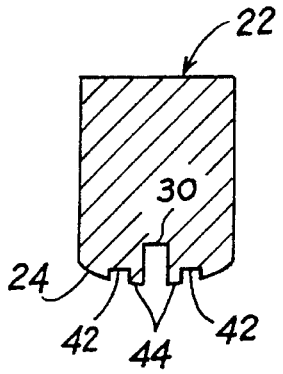
FIG. 9 is a cross-sectional side view of the hanger bar of FIG. 8 as seen from line 8—8 in that figure.
Figure 8:
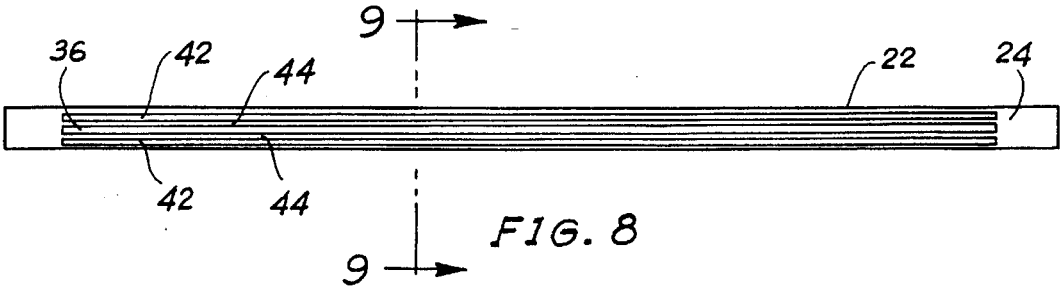
FIG. 8 is a bottom plan view of the underside of the hanger bar according to a different embodiment of the invention illustrating two lateral grooves milled alongside the longitudinal inset groove.

In another embodiment of the invention, the assembly step is further simplified by eliminating the need for using a copper rod during welding. This is achieved by a particular procedure followed while cutting the groove 36 into the underside 24 of the hanger bar 22. As part of the same milling operation, two parallel lateral grooves 42 are also milled alongside groove 36 (except, if preferred, for the segments corresponding to windows 27), thereby creating a ridge 44 on each side of that groove. The resulting configuration is illustrated in FIG. 8, which is a bottom plan view of the milled hanger bar, and in the cross-sectional view of FIG. 9. Once the hanger bar 22 has been so milled and the top edge of the starter sheet 26 is recessed into the groove 36, the welding process is accomplished simply by melting the ridges 44 into the starter sheet 26 to form a permanent bond with it. Obviously, the grooves 42 only need to be sufficiently deep to provide enough material for bonding (such as a 3 mm thick ridge 44), while groove 36 must be somewhat deeper to provide a stable slot for engaging the mother plate 26 (e.g., 6.4 ram).

Figure 10:
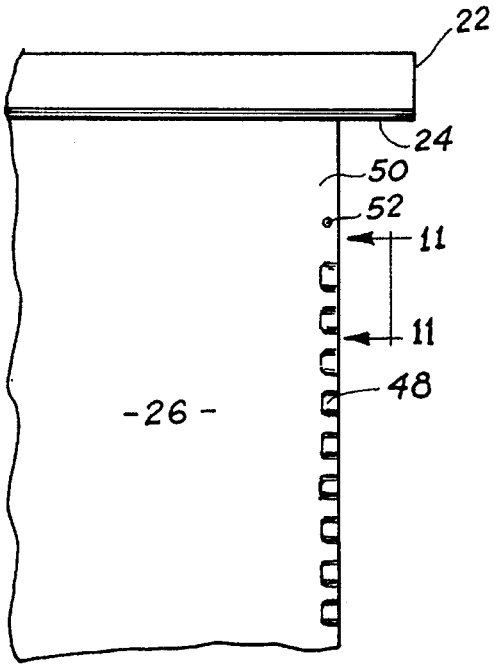
FIG. 10 is a partial elevational view of a cathode according to the invention having notched vertical edges for additional structural strength and for providing retaining means to insulating protective strips.
Figure 11:
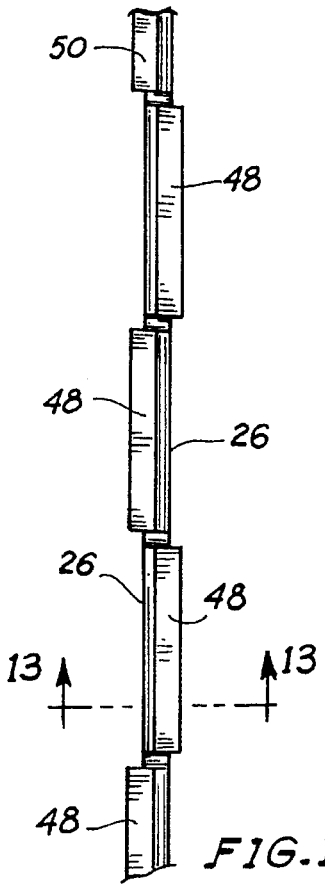
FIG. 11 is a partial side view of a notched starter-sheet vertical edge of FIG. 10 as seen from line 11—11 in that figure.

Yet another improvement over the prior art consists of notched lateral edges developed to strengthen the rigidity of the starter sheet 26 (illustrated in FIG. 10). Given the modest thickness of the starter sheets used for electrolytic processes (2.9–3.2 mm), they are prone to bending when subjected to lateral forces, as often is the case while being handled during installation, removal and stripping. I found that the addition of uniform, lateral notches or tabs 48 in each vertical edge 50 of the starter sheet 26, alternating from side to side with respect to the plane of the starter sheet, gives an additional degree of lateral stiffness that greatly decreases the chances of bending during normal use. These notches are formed along the vertical edges of the starter sheet to a predetermined point above the nominal liquid level of electrolyte in the process cell. All bent edges are preferably equal in length and evenly spaced from the bottom of the metal starter sheet to a stopping point below a mounting hole 52 located above the liquid level line. FIG. 11 is an enlarged side-view illustration of the notches 48 stamped or otherwise formed in the vertical edges 50 of the starter sheet according to this invention.

Figure 13:
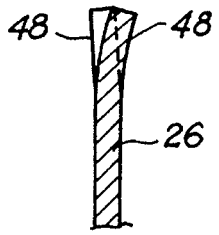
FIG. 13 is a partial cross-sectional view of the notched starter-sheet edge of FIG. 11 as seen from line 13—13 in that figure.
Figure 12:
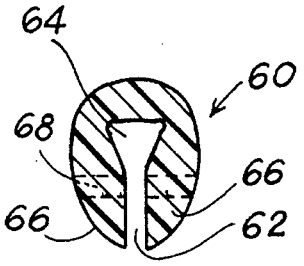
FIG. 12 is a cross-sectional view of an insulating protective strip adapted for resiliently clamping over the notched starter-sheet edge of FIGS. 11 and 13.

I also found that this feature can be further utilized to facilitate the installation and removal of the protective and insulating strips that conventional cathodes use to prevent the electro-deposition of metal on that portion of the cathode. Typically, such strips are riveted on the edge 50 and bonded to the metal to avoid buckling and partial exposure of the segments between rivets. Instead, the configuration of the notches 48 provides a ready-made retaining structure for a conforming strip along the entire length of the edge. One example of such a conforming strip 60 is illustrated in cross-section in FIG. 12, showing a longitudinal mouth 62 adapted for receiving and resiliently clamping the laterally-formed notches 48 (seen in cross-section in FIG. 13) in each lateral edge 50 of the starter sheet. The mouth 62 interlocks with the raised tabs formed by the notched edges in the mother blank. The geometry of the inner throat portion 64 of the mouth 62, conforming to the raised-tab configuration of the edge 50, prevents the strip 60 from buckling or otherwise separating from the mother blank in a lateral direction.

Figure 14:
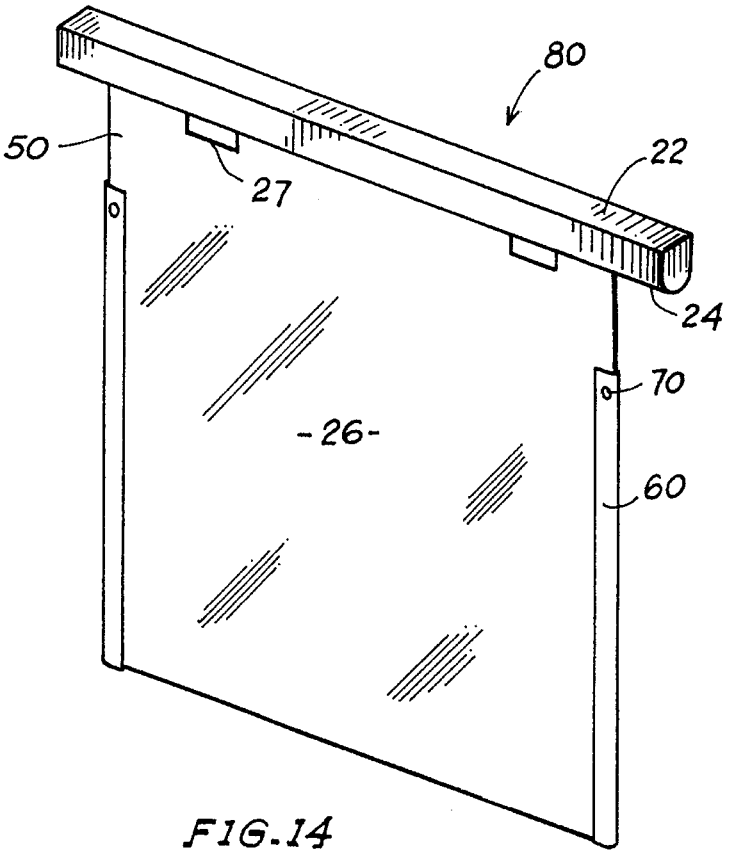
FIG. 14 is a perspective view of the preferred embodiment of the present invention.

The strip 60 is installed simply by slipping it over the edge of the starter sheet such that the notches 48 fit snugly within the inner throat portion 64 of the mouth 62, and such that the outer jaws 66 of the strip clamp the flat portion of the starter sheet 26. A pin, rivet or other retaining means 70 (see FIG. 14) is passed through a transverse perforation 68 in the strip 60 and in the matching mounting hole 52 in the starter sheet to prevent it from sliding out. The mounting pin 70 is secured to the strip with an appropriate adhesive compatible with the strip and starter-sheet material. This ensures the retention of the strip 60 and prevents its deformation during use without the need for also adding bonding material between the strip and the metallic surface of the starter sheet. FIG. 14 illustrates this embodiment 80 of the invention.

A strip made of chlorinated polyvinylchloride (CPVC), a resilient non-conductive material, that fully covers the raised tabs 48 of the starter sheet, is ideal for this application. The exterior surface of the edge strip 60 must be smooth and free of any sharp corners or striations that would interfere with any of the automated mechanical equipment used in the electrolytic process or provide a surface for the deposition of purified metal. Furthermore, the chemical composition of this material provides total insulation to electrical current, thereby allowing no growth of electro-deposited metal around the lateral edges of the metallic mother blank.

The preferred material for manufacturing the apparatus of the invention is solid copper for the hanger bar 22 and stainless steel (316L, 2205 or other steel alloys) for the starter sheet 26. As mentioned, a CPVC edge strip is used. Note, though, that the features of the invention are applicable to any combination of materials suitable for any given electrolytic process, so long as the starter-sheet metal is appropriate for the electro-deposition of the electrolyte and the hanger-bar metal is a good conductor and can be welded to the hanger bar. Similarly, the invention is not limited to cathodes because it would be equally applicable to the manufacture of anodes requiring similar characteristics.

Various other changes in the details, steps and materials that have been described may be made by those skilled in the art within the principles and scope of the invention herein illustrated and defined in the appended claims. Thus, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent apparatus and methods.

I claim:

1. A method of manufacture of an electrode for an electrolytic process, comprising the following steps:

(a) providing a hanger bar with a convex underside;

(b) providing a flat starter sheet having a substantially straight top edge and two substantially vertical edges;

(c) milling a longitudinal inset groove along the underside of the hanger bar for receiving the straight top edge of the starter sheet, said groove having a proper clearance to allow said top edge to fit tightly without being forced and being of a depth and a length to fully accommodate said top edge of the starter sheet;

(d) milling two parallel lateral grooves alongside said longitudinal inset groove along the underside of the hanger bar, creating a ridge on each side of the longitudinal inset groove; and (e) welding said hanger bar and starter sheet together along said inset groove utilizing said ridge as welding material.

2. The method of claim 1, wherein said hanger bar is made of copper.

3. The method of claim 1, wherein said starter sheet is made of stainless steel.

4. The method of claim 1, wherein said hanger bar is made of copper and said starter sheet is made of stainless steel.

5. The method of claim 1, wherein said longitudinal inset groove is approximately 6 mm deep.

6. The method of claim 1, wherein said longitudinal inset groove is approximately 6 mm deep and said ridge on each side of the longitudinal groove is about 3 mm thick.

7. The method of claim 1, wherein said hanger bar is approximately 130 cm long, 2.5 cm wide, 3.8 cm high, and said convex underside has a radius of curvature of about 5 cm; wherein said starter sheet is approximately 110 cm high, 100 cm wide and 3 mm thick; and further comprising the step of bending said vertical edges laterally, alternating from side to side with respect to the starter sheet, to form lateral notches in the vertical edges thereof, providing notched vertical edges; and the steps of providing a resilient, insulating strip having a longitudinal mouth adapted for receiving and resiliently clamping said notched vertical edges, sliding the notched vertical edges through said longitudinal mouth in the strip, and providing retaining means for locking the strip in place,

8. An electrode manufactured according to the method of claim 1.

9. A method of manufacture of an electrode for an electrolytic process, comprising the following steps:

(a) providing a hanger bar with a convex underside, said hanger bar being made of copper;

(b) providing a flat starter sheet having a substantially straight top edge and two substantially vertical edges, said starter sheet being made of steel;

(c) milling a longitudinal inset groove along the underside of the hanger bar for receiving the straight top edge of the starter sheet, said groove having a proper clearance to allow said top edge to fit tightly without being forced and being of a depth and a length to fully accommodate said top edge of the starter sheet; and (d) welding said hanger bar and starter sheet together along said inset groove;

wherein said step (d) is performed while said hanger is at least partly immersed in a liquid bath of thermally-conductive material, and wherein said material is circulated at a rate controlled to maintain the hanger bar at a substantially constant and uniform temperature.

10. The method of claim 9, further comprising the step of bending said vertical edges laterally, alternating from side to side with respect to the starter sheet, to form lateral notches in the vertical edges thereof, providing notched vertical edges.

11. The method of claim 10, further comprising the steps of providing a resilient, insulating strip having a longitudinal mouth adapted for receiving and resiliently clamping said notched vertical edges; sliding the notched vertical edges through said longitudinal mouth in the strip; and providing retaining means for locking the strip in place.

12. The method of claim 9, further comprising the step of milling two parallel lateral grooves alongside said longitudinal inset groove along the underside of the hanger bar, creating a ridge on each side of that groove; and utilizing said ridge as welding material during step (d).

13. An electrode manufactured according to the method of claim 9.

* * * * *